United States Patent [19]

Shekleton

[11] Patent Number: 4,943,230

[45] Date of Patent: Jul. 24, 1990

[54] FUEL INJECTOR FOR ACHIEVING SMOKELESS COMBUSTION REACTIONS AT HIGH PRESSURE RATIOS

[75] Inventor: Jack R. Shekleton, San Diego, Calif.

[73] Assignee: Sundstrand Corporation, Rockford, Ill.

[21] Appl. No.: 255,966

[22] Filed: Oct. 11, 1988

[51] Int. Cl.[5] ..... F23M 9/00

[52] U.S. Cl. ..... 431/183; 431/9; 431/182

[58] Field of Search ..... 431/182, 183, 9; 110/264, 347; 239/404

[56] References Cited

U.S. PATENT DOCUMENTS

| | | | |
|---|---|---|---|
| 2,905,234 | 9/1959 | Scholz | 239/404 |
| 2,976,920 | 3/1961 | Sanborn | 239/404 |
| 4,297,093 | 10/1981 | Morimoto et al. | 431/182 X |
| 4,431,403 | 2/1984 | Nowak et al. | 431/183 |
| 4,457,241 | 7/1984 | Itse et al. | 110/264 X |
| 4,630,554 | 12/1986 | Sayler et al. | 110/264 |
| 4,685,882 | 8/1987 | Binasik et al. | 431/182 |
| 4,695,245 | 9/1987 | Kotzmann | 239/404 X |
| 4,726,760 | 2/1988 | Skoog | 110/347 X |

*Primary Examiner*—Edward G. Favors
*Attorney, Agent, or Firm*—Wood, Phillips, Mason, Recktenwald & VanSanten

[57] ABSTRACT

High flame stability and good starting qualities are obtained in a relatively smoke free hot gas generator including a housing 10 having an interior combustion chamber 12 with a diverging interior wall 20 that is generally a surface of revolution. An axially directed opening 18 is centered in the wall 20 and an outer, oxidant inlet 48, 52 is provided and includes swirler vanes 50 for introducing into the chamber 12 at the interior wall 20 a swirling, hollow body of oxidant such that centrifugal force will create a diverging hollow body of swirling oxidant on the interior wall 20. A central fuel inlet 52, 58 is located within the opening 18 and within the oxidant inlet 48, 52 and is generally concentric therewith. The fuel inlet 52, 58 includes swirler vanes 50 for introducing a hollow cone-like body 90, 92 of atomized fuel into the chamber 12 such that the outer surface 94 of the cone-like body 90, 92 is on the inner surface 96 of the diverging body of oxidant from substantially the point of initiation of the latter to minimize mixing between the bodies.

7 Claims, 2 Drawing Sheets

FUEL INJECTOR FOR ACHIEVING SMOKELESS COMBUSTION REACTIONS AT HIGH PRESSURE RATIOS

FIELD OF THE INVENTION

This invention relates to a hot gas generator, and more specifically, to an improved fuel and oxidant injection system for such generators whereby carbonaceous fuel can be combusted without generation of smoke.

BACKGROUND OF THE INVENTION

Hot gas generators are also known as combustors and are employed for a number of purposes. For example, they are frequently utilized to generate gases of combustion for driving gas turbine engines.

Early gas turbine engines commonly used swirl stabilized flames employing so-called swirl fuel pressure injection. As attempts were made to operate such turbines at higher and higher engine pressure ratios as, for example, in excess of 10 to 1 or more, such injectors produced high exhaust smoke. As a consequence, swirl air blast fuel injection was developed. Swirl air blast fuel injection is in common use today and eliminates the smoke problems that occurred in the early turbines. However, the elimination of smoke was not without an undesirable side effect, specifically, a loss in flame stability and a severe reduction in the ability to reliably start the turbine engine at high altitudes. The present invention is directed to overcoming one or more of the above problems.

SUMMARY OF THE INVENTION

It is the principal object of the invention to provide a new and improved hot gas generator. More particularly, it is an object of the invention to provide a hot gas generator that may be utilized to provide gases of combustion for turbine engines and wherein carbonaceous fuel is combusted with little or no smoke and yet the hot gas generator does not suffer a loss in flame stability or in its ability to generate gas and start a turbine at high altitudes.

An exemplary embodiment of the invention achieves the foregoing objects in a hot gas generator which includes a housing having an interior combustion chamber which in turn includes a diverging interior wall that is generally a surface of revolution. An axially directed opening is centered in the wall and an outer oxidant inlet is disposed in the opening and includes swirler vanes for introducing into the chamber at the interior wall, a swirling hollow body of oxidant such that centrifugal force will create a diverging hollow body of swirling oxidant on the interior wall. Also included is a central fuel inlet within the opening and at the oxidant inlet and generally concentric therewith. The fuel inlet includes swirler vanes for introducing a swirling hollow cone-like body of atomized fuel into the chamber such that the outer surface of the cone-like body is on the inner surface of the diverging body from substantially the point of initiation of the latter to minimize mixing between the bodies.

As a consequence of this construction, a laminar flame of high stability exists at the interface of the two bodies and such flame and recirculating hot gases are operative to rapidly vaporize the atomized body of fuel to prevent the formation of smoke.

According to one embodiment of the invention, the swirler vanes are configured to cause the bodies to swirl in the same direction for minimum flame length and minimum smoke. According to another embodiment of the invention, the vanes are such as to cause the bodies to swirl in opposite directions to provide maximum stability and flame starting.

The invention contemplates that the inlet includes a nozzle with an axially facing discharge opening.

According to one embodiment of the invention, the nozzle includes a generally cylindrical outer surface which defines part of the oxidant inlet and the discharge opening, in the direction of fuel flow, includes a first converging section merging with a second diverging section, and the diverging section in turn merges with the outer surface generally at the point of initiation of the diverging body of oxidant.

According to another embodiment of the invention, the nozzle includes an outer surface which also defines part of the oxidant inlet and, in the direction of fuel flow, terminates in a converging outer surface. The discharge opening is defined by a converging inner surface and the opening further includes a necked down area defining part of the oxidant inlet and aligned with the converging surfaces to delineate the point of initiation of the diverging body of oxidant.

The invention contemplates the provision of fuel delivery means connected to the fuel inlet for delivering fuel thereto at a pressure sufficiently high that the combustor will operate at a pressure ratio in excess of 10 to 1; and preferably 20 to 1 or more.

Other objects and advantages will become apparent from the following specification taken in connection with the accompanying drawings.

DESCRIPTION OF THE PREFERRED EMBODIMENTS

Figure 1:
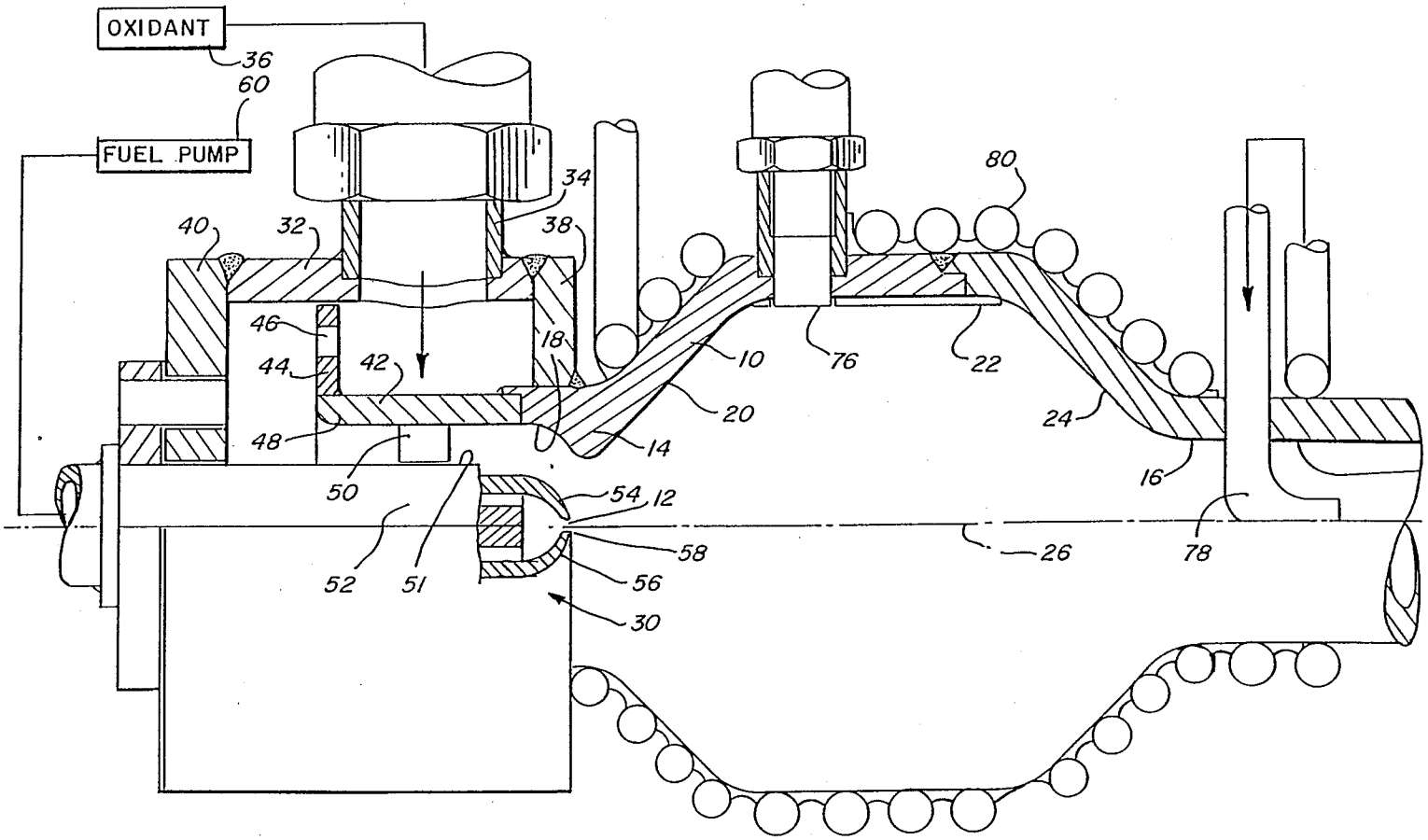
FIG. 1 is a sectional view of a hot gas generator made according to the invention.

An exemplary embodiment of a hot gas generator made according to the invention is illustrated in FIG. 1 and is seen to include a housing or vessel 10 having an interior, combustion chamber 12. The combustion chamber 12 includes an inlet end 14 and an outlet end 16. At the inlet end 14, there is an opening 18 and the interior surface is a surface of revolution which diverges outwardly as at 20 toward the outlet end 16 to merge with a generally cylindrical central section 22 and finally a converging section 24 which extends to the outlet 16. In the usual case, the diverging interior surface 20 of the combustion chamber 12 will be a cone generated about the axis shown at 26.

An injector assembly, generally designated 30, is disposed within the opening 18.

The injector assembly 30 may include an outer sleeve 32 provided with a nipple 34 or other fitting for connection to a source of oxidant 36. The source of oxidant 36 may provide air, oxygen enriched air or even molecular oxygen as desired.

End pieces 38 and 40 are secured to opposite ends of the sleeve 30 to define a closed chamber and an inner sleeve 42 is disposed within the resulting manifold and is sealed to the opening 18 by any suitable means.

An orifice plate 44 including the series of peripheral orifices 46 is supported on the exterior side of the inner sleeve 42 so as to be interposed in the flow path between the nipple 34 and an end 48 of the sleeve 42 remote from the opening 18. The orifices 46 thus provide a choked orifice for oxidant so that the flow of oxidant into the sleeve 42 will remain constant irrespective of pressure changes within the combustion chamber 12 for a constant pressure of oxidant applied to the nipple 34.

The sleeve 42, on its inner surface, may mount a series of air swirler vanes 50 which extend generally radially inward. Thus, air entering the inner sleeve 42 through the end 48 will be directed axially along the axis 26 into the opening 18 for the chamber 12 and will be rotating as a result of the swirl provided thereto by the vanes 50.

The air inlet in part defined by the sleeve 42 is completed by the outer surface 51 of a nozzle 52 for the injection of fuel. The surface 51 is in close proximity to the radially inner surface of the vanes 50 and it is coaxial with the inner surface of the sleeve 42 and concentric with the axis 26. As a result, the oxidant inlet thus defined is a generally hollow body that is a surface of revolution.

Figure 2:
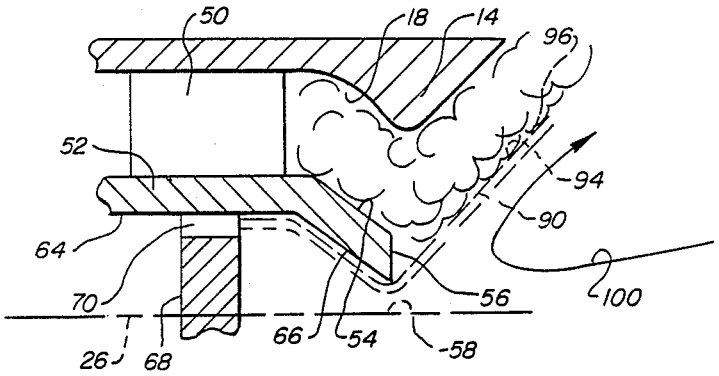
FIG. 2 is an enlarged, fragmentary sectional view of one form of oxidant and fuel inlet employed in the invention.

In the embodiment illustrated in FIGS. 1 and 2, the nozzle 52 includes a converging downstream end 54 that is aligned with the necked down portion 42. The converging end 52 terminates in a generally planar end 56 having a central, axially facing discharge opening 58.

The nozzle 52 is adapted to receive fuel under pressure from a fuel pump shown schematically at 60

The nozzle 52 includes a hollow interior 62 with an interior surface 64. The interior surface 64 also converges in the embodiment illustrated in FIGS. 1 and 2 as shown at 66 in the direction of fuel flow to terminate in the opening 58. Just upstream of the opening 58 is a baffle 68 which is centrally located within the nozzle 52 and, at its radially outer periphery is provided with fuel swirler vanes 70. Fuel is thus given a swirling motion as it passes by the vanes 70 toward the converging surface 68. Because of the converging nature of the surface 68, such fuel is accelerated due to the action of centrifugal force thereupon as it moves radially inwardly and axially toward the opening 58.

The fuel and air mixture injected into the chamber 12 by the injector 30 may be ignited by an igniter 76. The resulting gases of combustion will exit through the outlet 16. If desired, a second fuel injector 78 may be located at the outlet 16 to inject fuel into the hot gases of combustion to cool the same and to generate an increased volume of gas as a result of vaporization of such fuel. In some cases, the exterior of the vessel 10 may be provided with a wrap of tubing 80 or the like through which the fuel may be circulated prior to being directed to the injector 30 or the injector 78 for the purpose of cooling the walls of the vessel 10.

Figure 3:
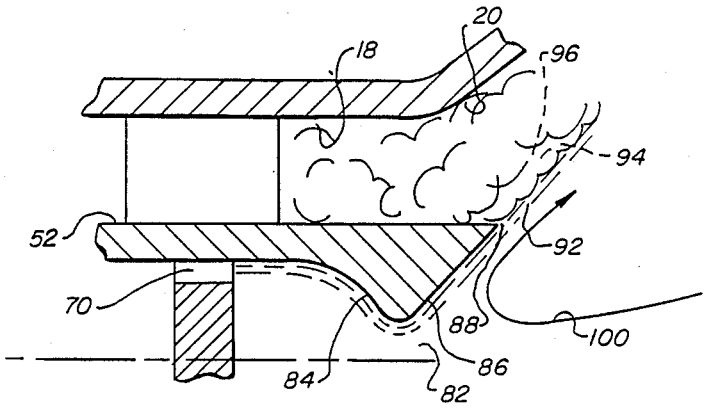
FIG. 3 is a view similar to FIG. 2 but of a modified embodiment of oxidant and fuel inlet.

A second embodiment is illustrated fragmentarily in FIG. 3 and in this case, it will be seen that the opening 18 is lacking a necked down portion such as the portion 16. Rather, the opening 18 goes directly to the diverging interior wall section 20.

In addition, the nozzle 52 has a purely cylindrical outer surface throughout its entire length. It, of course, includes a downstream discharge opening shown at 82 which in turn is defined by a upstream, conical, converging interior surface 84 which joins to a second, conical, diverging surface 86, which in turn merges at a point 88 with the cylindrical surface 51 of the nozzle 52. The point 88 is generally aligned with the interface between the opening 18 and the diverging surface 20. In addition, the embodiment of FIG. 3 is provided with the swirler vanes 70 and it will be appreciated that there is an acceleration of fuel as it flows along the converging surface 84 after leaving the swirler vanes 70.

As a result of the foregoing constructions, a hollow body of oxidant is generated by the swirler vanes 50 which is introduced into the chamber 12 along the diverging interior wall 20. Because this body of oxidant is swirling, centrifugal force will cause the same to move radially outwardly and adhere rather well to the wall 20. Where the wall is conical as illustrated in FIG. 1, the body of oxidant will generally be in the form of a hollow cone. Similarly, the nozzles 52 of both FIGS. 2 and 3 will generate a hollow cone-like body of fuel shown at 90 in FIG. 2 and at 92 in FIG. 3. Because of the relative thinness of the nozzle material 72 between the outer surface at the converging end 54 and the discharge opening 58 in the embodiment of FIG. 2, the cone-like body of atomized fuel 50 will have its outer surface 94 applied essentially directly against the inner surface 96 of the cone-like body of oxidant. At this area, a laminar flame will exist and there will be very little mixing of fuel with the air.

In the embodiment illustrated in FIG. 3, there will be similar action, the difference principally being in the fact that the provision of the diverging surface 86 is such that the swirling fuel tends to adhere to the surface 86 to aid in forming the cone-like body which otherwise would be formed by the nozzle geometry coupled with the fact that the fuel is discharged axially and the centrifugal force of the swirl of the fuel causes radially outward movement as the fuel progresses axially into the chamber 12.

In addition, a pattern of recirculating gas shown by arrows 100 in both FIGS. 2 and 3 will be formed. This will be hot gas and the same will impinge upon the interior surface of the hollow body of fuel very shortly after its origination to rapidly cause evaporation of the same by reason of the temperature differential.

An important feature of the invention is the fact that the conical body of fuel is applied to the interior surface of the diverging body of oxidant almost exactly at the time such divergence of the body of oxidant is initiated. In this regard, it will be seen that the necked down portion 14 and the discharge opening 58 in the embodiment of FIG. 2 are virtually coplanar in a plane transverse to the axis 26. Similarly, the point 88 whereat the surface 86 and the cylindrical outer surface of the nozzle 52 merge is virtually coplanar with the interface between the opening 18 and the diverging surface 20 of the combustion chamber 12 which are the controlling instrumentalities in permitting the divergence of the hollow body of oxidant in the embodiment of FIG. 3. This feature of the invention enables the system to operate at relatively high pressure ratios, i.e., in excess of 10 to 1 and accordingly, the fuel pump 60 is sized to deliver fuel to the system at pressures sufficiently high so that such high operating pressure ratios may be obtained. In the preferred embodiment, operation is on pressure ratios on the order of 20 to 1 or more.

It has been found that excellent flame stability and good start reliability at high altitudes come under simulated conditions is obtainable through the invention. At the same time, smoke generation is minimized. This is due to the fact that very little mixing between fuel and oxidant occurs by reason of the unique relation of the body of atomized fuel to the diverging body of oxidant.

I claim:

1. A hot gas generator comprising:

a housing including an interior combustion chamber having a diverging interior wall that is generally a surface of revolution;

an axially directed opening centered in said wall;

an outer, oxidant inlet in said opening and including swirler vanes for introducing into said chamber at said interior wall a swirling, hollow body of oxidant such that centrifugal force will create a diverging hollow body of swirling oxidant on said interior wall; and a central liquid fuel inlet within said opening and said oxidant inlet and generally concentric therewith, said fuel inlet including means comprising swirler vanes for introducing a swirling hollow cone-like body of atomized liquid fuel into said chamber such that the outer surface of said cone-like body is on the inner surface of said diverging body from substantially the point of initiation of the latter to minimize mixing between said bodies.

2. The hot gas generator of claim 1 wherein said swirler means comprising vanes are for causing said bodies to swirl in the same direction for minimum flame length and smoke.

3. The hot gas generator of claim 1 wherein said swirler means comprising vanes are for causing said bodies to swirl in opposite directions for maximum stability and flame starting.

4. The hot gas generator of claim 1 wherein said fuel inlet includes a nozzle with an axially facing discharge opening.

5. The hot gas generator of claim 4 wherein said nozzle includes a generally cylindrical outer surface defining part of said oxidant inlet and said discharge opening, in the direction of fuel flow, includes a first converging section merging with a second diverging section, said diverging section merging with said outer surface generally at said point of initiation.

6. The hot gas generator of claim 4 wherein said nozzle includes an outer surface defining part of said oxidant inlet and, in the direction of fuel flow, terminates in a converging outer surface, said discharge opening being defined by a converging inner surface, said opening further including a necked down area defining part of said oxidant inlet and aligned with said converging surfaces to delineate said point of initiation.

7. The hot gas generator of claim 1 further including fuel delivering means connected to said fuel inlet for delivering fuel thereto at a pressure sufficiently high that said combustor will operate at a pressure ratio in excess of 10/1.

* * * * *